US009446275B2

(12) United States Patent
Stone et al.

(10) Patent No.: US 9,446,275 B2
(45) Date of Patent: Sep. 20, 2016

(54) PURGING WATER IN A WATERPARK RESERVOIR BY INDUCING A SIPHON

(71) Applicant: Avalanche Waterslides, Inc., Carthage, MO (US)

(72) Inventors: Zachary Michael Stone, Columbia, MO (US); Michael Stephen Stone, Carthage, MO (US)

(73) Assignee: Avalanche Waterslides, Inc., Chamois, MO (US)

( * ) Notice: Subject to any disclaimer, the term of this patent is extended or adjusted under 35 U.S.C. 154(b) by 0 days.

(21) Appl. No.: 14/699,981

(22) Filed: Apr. 29, 2015

(65) Prior Publication Data

US 2015/0314188 A1 Nov. 5, 2015

Related U.S. Application Data

(60) Provisional application No. 61/985,465, filed on Apr. 29, 2014.

(51) Int. Cl.

| | |
|---|---|
| ***A63H 23/10*** | (2006.01) |
| ***A63B 9/00*** | (2006.01) |
| ***A63B 71/02*** | (2006.01) |

(52) U.S. Cl.

CPC ..... *A63B 9/00* (2013.01); *A63B 71/02* (2013.01); *A63B 2009/008* (2013.01)

(58) Field of Classification Search

CPC ..... A63H 23/00; A63H 23/10; A63H 23/16; A63G 31/00

USPC ..... 472/117, 128; 4/506, 507, 509; 239/289

See application file for complete search history.

(56) References Cited

U.S. PATENT DOCUMENTS

| | | | | |
|---|---|---|---|---|
| 4,149,710 | A | 4/1979 | Rouchard | |
| 6,210,287 | B1 | 4/2001 | Briggs | |
| 6,319,139 | B1 * | 11/2001 | Tracy | A63B 71/02 472/117 |
| 6,569,023 | B1 | 5/2003 | Briggs | |
| 6,739,979 | B2 * | 5/2004 | Tracy | B05B 17/08 472/117 |
| 8,821,304 | B2 * | 9/2014 | Ensing | A63G 21/18 472/128 |

OTHER PUBLICATIONS

International Searching Authority, International Search Report, PCT/US/2015/028354, Sep. 10, 2015, 2 pages.

* cited by examiner

*Primary Examiner* — Kien Nguyen

(74) *Attorney, Agent, or Firm* — Dwayne E. Rogge; Schacht Law Office, Inc.

(57) ABSTRACT

Disclosed herein is a method for purging water in a waterpark reservoir by inducing a siphon and several examples of an apparatus to achieve this result. The apparatus disclosed herein provides an emptying mechanism which may have no moving parts or valves between the inlet and the outlet and yet delivers a short term large volume dump or purge of water to patrons in an impact area of a patron region of a waterpark.

7 Claims, 7 Drawing Sheets

Fig 5
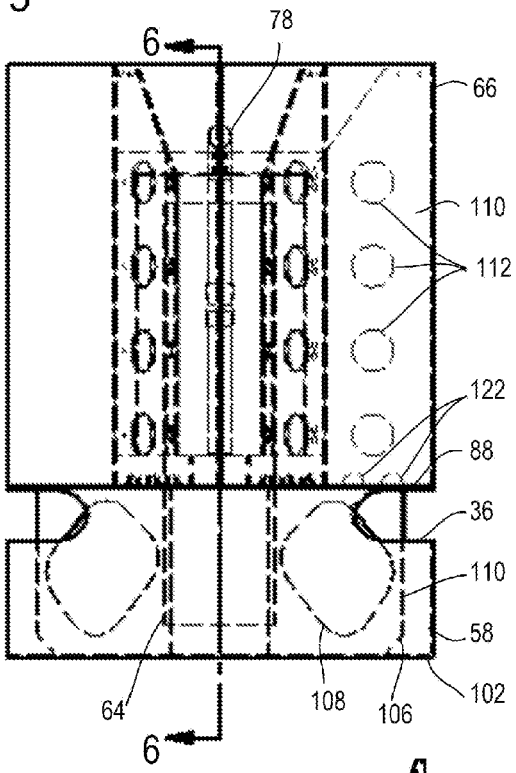
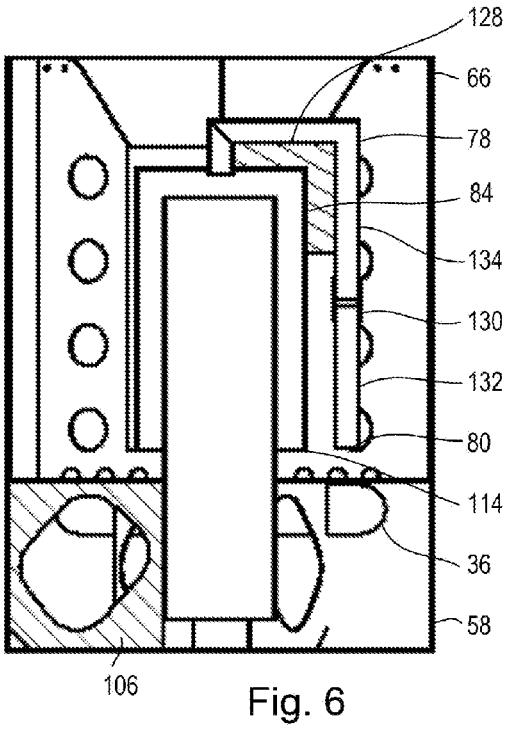
Fig. 6
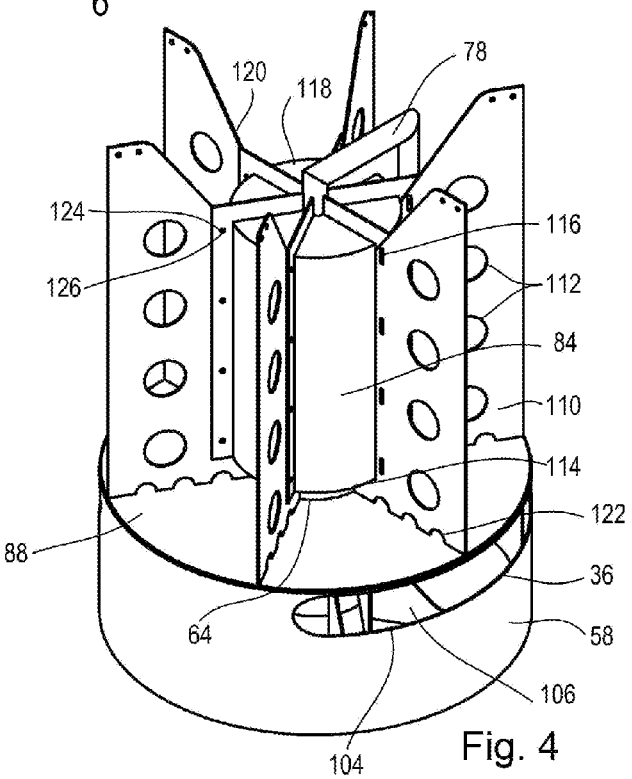
Fig. 4

PURGING WATER IN A WATERPARK RESERVOIR BY INDUCING A SIPHON

RELATED APPLICATIONS

This application claims priority benefit of U.S. Ser. No. 61/985,465, filed 29 Apr. 2014, incorporated herein by reference.

BACKGROUND OF THE DISCLOSURE

Field of the Disclosure

This disclosure relates to the field of water dumping play structures.

BRIEF SUMMARY OF THE DISCLOSURE

Disclosed herein is a water dump apparatus for a water park feature, the apparatus comprising: an upper reservoir configured to retain a volume of water therein substantially above a patron region of the water park; the upper reservoir having a lower interior surface, an upper edge, and a surrounding sidewall; a fluid inlet conduit in fluid communication with the interior surface of the upper reservoir configured to be coupled to a water pump providing a flow of water into the upper reservoir at an inflow rate; a substantially vertical lift conduit in fluid communication with the upper reservoir having a lower edge substantially above the lower surface of the upper reservoir and an upper edge substantially below the upper edge of the upper reservoir; a substantially vertical drain conduit sealed to the lift conduit and having an upper edge below and in fluid communication with the upper edge of the lift conduit and a lower edge below the lower edge of the lift conduit; an outflow in fluid communication with the lower edge of the drain conduit configured to periodically outflow water to the patron region at an outflow rate; and wherein the outflow rate is higher than the inflow rate.

The water dump apparatus as recited herein may further comprise a lower reservoir in fluid communication between the drain conduit and the outflow.

The water dump apparatus as recited herein may further comprise a plurality of outlets through sidewalls of the lower reservoir.

The water dump apparatus as recited herein may be arranged wherein the outlet has a lower edge vertically above the lower edge of the drain conduit such that a volume of water is retained between the lower edge vertically and the lower edge of the drain conduit forming a headspace in the lower reservoir configured to produce a headspace in the upper reservoir above the upper edge of the drain conduit.

The water dump apparatus as recited herein may further comprise a vent conduit having an upper end in fluid communication with an upper region of the lift conduit, and a lower end positioned above the lower edge of the lift conduit.

The water dump apparatus as recited herein may further comprise a seasonal drain provided in the lower reservoir configured to continuously allow passage of water there through and drain the lower reservoir when the water pump is not actuated.

The water dump apparatus as recited herein may be arranged wherein the outflow is above the patron region of the water park.

BRIEF DESCRIPTION OF THE SEVERAL VIEWS OF THE DRAWINGS

FIG. 4 is an assembled view of one example of the disclosed apparatus with an upper reservoir removed to show the inner components.

FIG. 5 is a side, hidden line view of the apparatus shown in FIG. 4.

FIG. 6 is a cutaway view taken along line 6-6 of FIG. 5.

DETAILED DESCRIPTION OF THE DISCLOSURE

Disclosed herein is a method for purging water in a waterpark reservoir by inducing a siphon and several examples of an apparatus 20 to achieve this.

Figure 17:
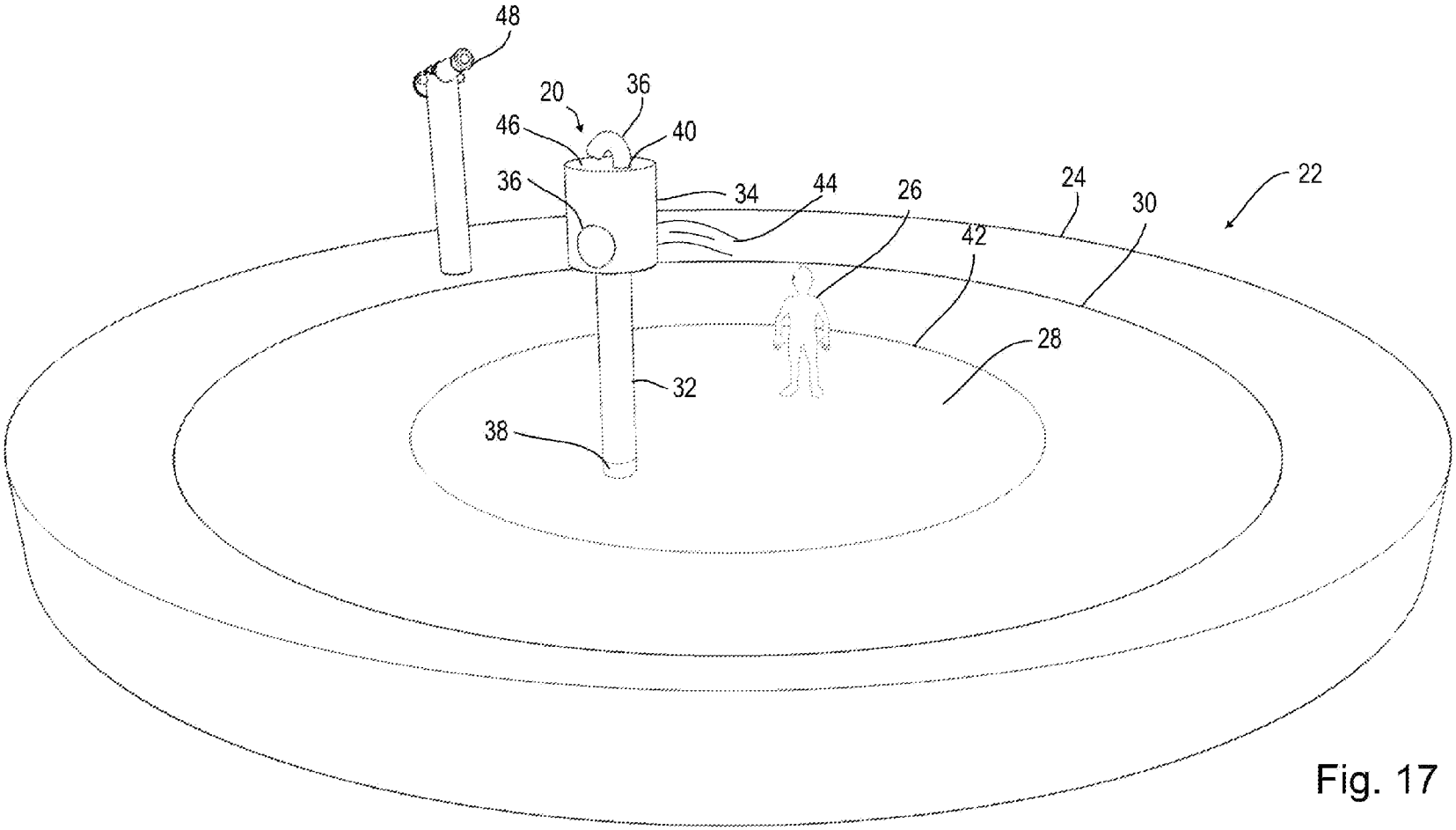
FIG. 17 is an environmental view of the apparatus shown in FIG. 5 in use.

Looking to FIG. 17 is shown a region of a waterpark 22 having a waterpark patron region 24 within which patrons 26 stand upon floor 28 having a flow of water 30 flowing there across. Shown near the center of the patron region 24 is an apparatus 20 including a support structure 32 and a reservoir assembly 34 attached to the top thereof. The reservoir assembly 34 having an inlet 36 fluidly coupled to a pump 38 which pumps the water 30 from the patron region 24 through an optional valve 40 into the reservoir assembly 34. The reservoir assembly 34 is arranged as shown below to release a large volume of water which is contained within the reservoir assembly 34 through an outlet 36 into an impact area 42 of the patron region 24. A patron 26 standing in or near the impact area 42 will be directly affected by an outflow 44 from the reservoir assembly 34. Alternatively or in addition to the inlet 36, a portion of the upper surface 46 of the reservoir assembly 34 may be open such that patrons 26 may direct a spray nozzle 48 or equivalent apparatus so as to direct a stream of water into the reservoir assembly 34 to more rapidly fill the reservoir 34 to a dump (purge) cycle as will be described below.

The disclosure details an apparatus 20 in which may utilize specially positioned pipes/channels to achieve a self-siphoning outflow once filled to a determined height. The nature of the apparatus 20 is to store water for a period of time, allowing an inlet 36 with a relatively low flow rate to fill a portion of the reservoir assembly 34, and purge substantially all of the water within the reservoir assembly 34 at once. This purging outflow creates an enjoyable wave of water that builds anticipation with the patron(s) 26 during a fill period.

This disclosure includes a large water holding tank or reservoir assembly 34 that empties a majority of its water at once during substantially consistent fill/dump intervals. Prior pivoting bucket water dump type features are extremely popular such as disclosed in U.S. Pat. No. 6,210,287 incorporated herein by reference, however are relatively expensive to fabricate, and need calibrated counterweights/bearings and valves due to the moving parts and delicate balances required for operation.

The apparatus 20 disclosed herein delivers an emptying mechanism which may have no moving parts or valves between the inlet 36 and the outlet 36. By decreasing the manufacturing/installation cost relative to pivoting bucket water dump apparatus, the apparatus 20 disclosed herein is acquirable by waterparks with limited financial resources. Also, long term maintenance of pivoting bucket water dump apparatus involves replacement of bearings/counterweights/valves, which can become quite costly. Maintenance is further negatively impacted as the waterpark patron region 24 is generally inaccessible to heavy equipment after completion of the waterpark. Utilizing the apparatus 20 disclosed herein there is no maintenance required: no moving parts to wear out, and with proper material selection, the apparatus 20 will last several generations.

Disclosed herein is an apparatus 20, the components of which may be comprised of a corrosion resistant material, such as: stainless, anodized aluminum galvanized steel, concrete, PVC, polycarbonate, acrylic, or fiber reinforced plastic (fiberglass). This construction material can be painted or themed for aesthetics. The intent of this disclosed apparatus is to create the same anticipated, massive purge of a large quantity of water at the outlet 36 as currently available in pivoting bucket water dump apparatus, without the high cost of bearings or valves present in those designs. Because the large volume (weight) of water does not swing, compression and tension loading through structural components such as support structure 32 will be less than in pivoting bucket water dump apparatus, leading to construction and maintenance cost savings in the structure and footings as well as safety to patrons 26. Also, since no moving parts are necessary for reliable purging of the apparatus 20, long term maintenance is greatly reduced relative to pivoting bucket water dump apparatuses such as disclosed in U.S. Pat. No. 6,210,287 leading to additional savings.

Figure 1:
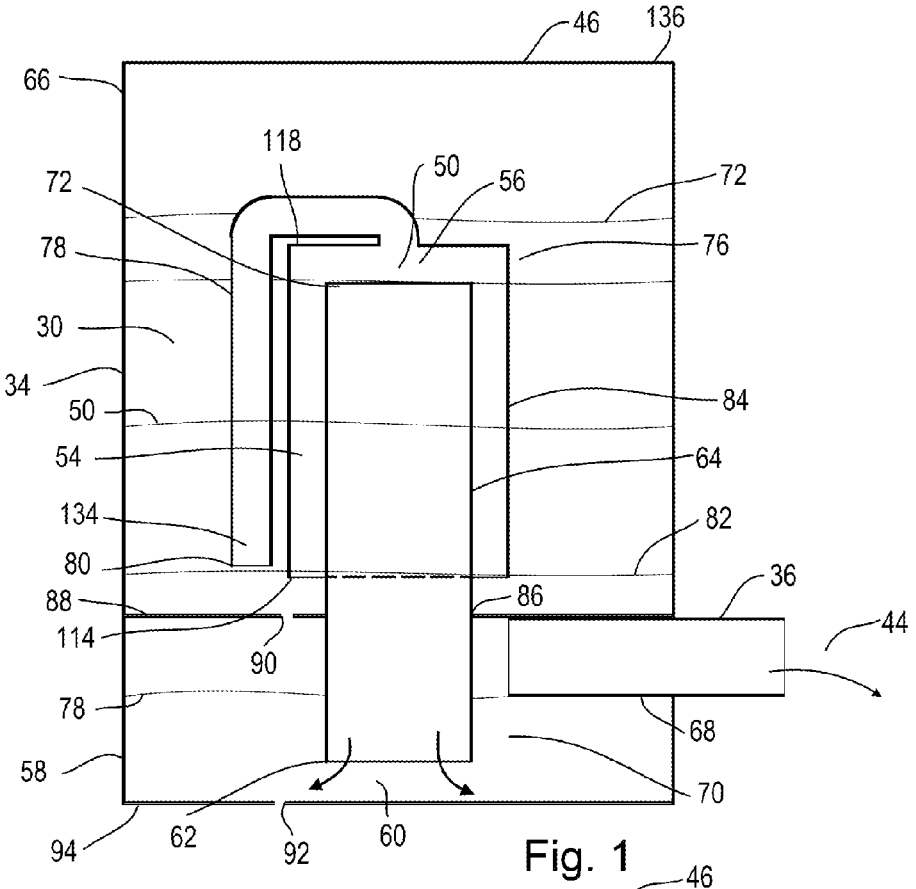
FIG. 1 is a highly schematic view of one example of the disclosed apparatus.

In one example as shown in FIG. 1, upon the start of the pump 38, the reservoir assembly 34 begins filling with water 30. As the water level 50 in the reservoir assembly 34 rises, the rising water 30 displaces air 52 inside a flow zone 54. This creates a positive pressure for the air 52 to be pushed through the air pressure zone (APZ) 56 and exert pressure into a lower reservoir 58. If no water is present in the lower reservoir 58, then the higher pressure air escapes through the outlet 36. If water 60 is present and above the lower edge 62 of a drain conduit 64, the air will compress inside the drain conduit 64. As the air contracts in volume (increases in pressure), the compressed air will exert pressure and displace water in the lower reservoir. The head pressure of the water 60 in the lower reservoir 58 will push back on the pressurized air, until the air pocket reaches the lower edge 62 of the drain conduit 64. When a large bubble of pressurized air is released, the pressure inside the drain conduit 64 is momentarily decreased to below the head pressure of the lower reservoir 58, and this pattern is harmonically repeated until an upper reservoir 66 portion of the reservoir assembly 34 is filled to a maximum level. The maximum fill level 74 of the upper reservoir 66 will be higher than an upper edge 66 of the drain conduit 64, the height 76 can be adjusted based on the height 70 of the lower edge 68 of the outlet 36 of the lower reservoir 58. The maximum fill level 74 of the upper reservoir 66 of one example will consistently be between 1-3" higher water elevation change than the upper edge 66 output of the drain conduit 64 to most effectively begin a purge or outflow cycle.

The drain conduit 64 will continue to have a smaller volume as water is harmonically expelled through the lower edge 62 of the drain conduit 64. Once the water level 50 reaches a critical state near the maximum fill level 72, the water 30 in the upper reservoir 66 will begin to enter the APZ 56. The pressurized air within the drain conduit 64 will act as a wall, holding back the water 30 within the upper reservoir 66 until the water 30 flowing downward through the drain conduit 64 reaches a critical flow rate. Since the head pressure (height 70) is static in the lower reservoir 58 and the head pressure (height 76) is increasing as the water level 50 rises, the head pressure in the upper reservoir 66 will push the pressurized air within the drain conduit 64 out until this critical flow rate is reached. Air is released through the outlet 36 of the drain conduit 64, creating a slightly negative pressure for the water to be vacuumed over the upper edge 72 starting a siphon. In one example, the height 76, and the height 70 are between 1"-10" at the initiation of a purge cycle. The siphon pulls the water 30 from the upper reservoir 66, raising the water level 78 in the lower reservoir 58 out the outlet 36 and gushes water faster than the fill of the reservoir 34. In one example, the outlet flow 44 rate is up to 100 times in the inlet 36 flow rate. This is the desired effect, and timing (or fill of the holding tank) can be regulated to build anticipation. In one example, the timing is regulated to approximately 5-15 min intervals.

Once a complete fill/dump cycle is complete, the siphon is broken by the water level 50 of the upper reservoir 66 dropping below the lower edge 62 of the drain conduit 64. In examples utilizing a vent conduit 78, the siphon is broken by the water level 50 of the upper reservoir 66 dropping below the lower edge 80 of the vent conduit 78 to final water level 82. The velocity of the water 30 draining through the drain conduit 64 will bring the final water level 82 below the upper edge 72 of the drain conduit 64 once the siphon is broken as air is sucked into the vent conduit 78 or lift conduit 84. The water 30 may continuously be added to the upper reservoir 66 through the fill pipe or inlet 36, starting the purge cycle again. This harmonic repetition of the fill/purge cycle will continue until the fill pump 38 is turned off.

In one example, the drain conduit 64 passes through a surface defining a void 86 through the lower surface 88 of the upper reservoir. The conduit 64 may be sealed such as by welding to the void 86 in the upper reservoir 66. In one example a small gap may be left to allow for draining of the upper reservoir 66.

In another example, a seasonal drain 90 may be provided in the lower surface 88 of the upper reservoir 66. This seasonal drain may be a surface defining a very small void to allow for continuous flow of the water 30 there through. In such an example, it is provided that the inlet 36 and pump 38 provide water at a substantially higher flow rate such that the seasonal drain 90 is substantially inconsequential during normal operation of the apparatus 20. When the pump 38 is turned off when the apparatus 20 is not in operation such at night, in the winter, or during maintenance, the water 30 will flow through the seasonal drain 90 and will not cool in the upper reservoir 66 causing a detrimental condition to operation of the apparatus 20.

Similarly, a seasonal drain 92 may be provided in the lower surface 94 of the lower reservoir 58. This seasonal drain may be a surface defining a very small void to allow for continuous flow of the water 30 there through during operation of the apparatus 20. In such an example, it is provided that the drain conduit 64 provides water at a substantially higher flow rate such that the seasonal drain 90 is substantially inconsequential during normal operation of the apparatus 20. When the apparatus 20 is not in operation such at night, in the winter, or during maintenance, the water 30 will flow through the seasonal drain 90 and will not cool in the upper reservoir 66 causing a detrimental condition to operation of the apparatus 20.

Figure 2:
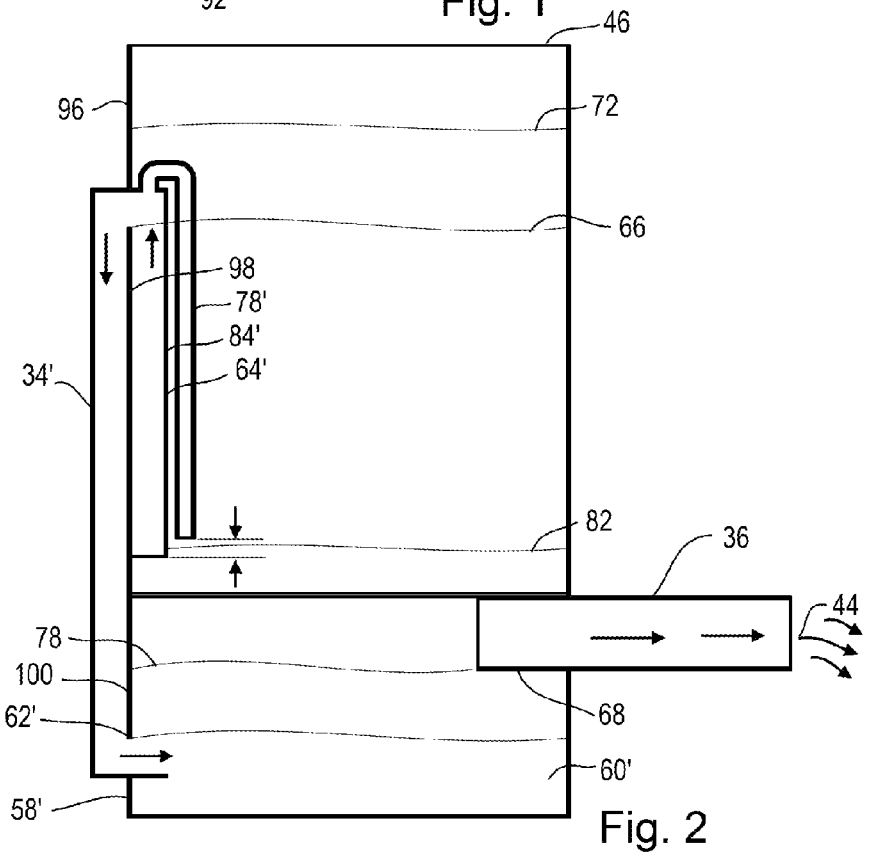
FIG. 2 is a highly schematic view of the example shown in FIG. 1 using a lift conduit on the outer surface of the outer tank.

Looking to FIG. 2 is shown a second example of the apparatus 20. In this example, components having a similar design or function to that shown in the first example of FIG. 1 utilize the same numeric identifier with an apostrophe (') to denote the second example. In this example, the reservoir assembly 34' includes an upper reservoir 66' having an outer wall surface 96 and an inner surface 98. In this example it can be seen that one surface of the lift conduit 84' is formed by the inner surface 98. It can also be seen that one surface of the drain conduit 64' is formed by the outer surface 96 of the upper reservoir 66' and an outer surface 100 of the lower reservoir 60'.

Figure 3:
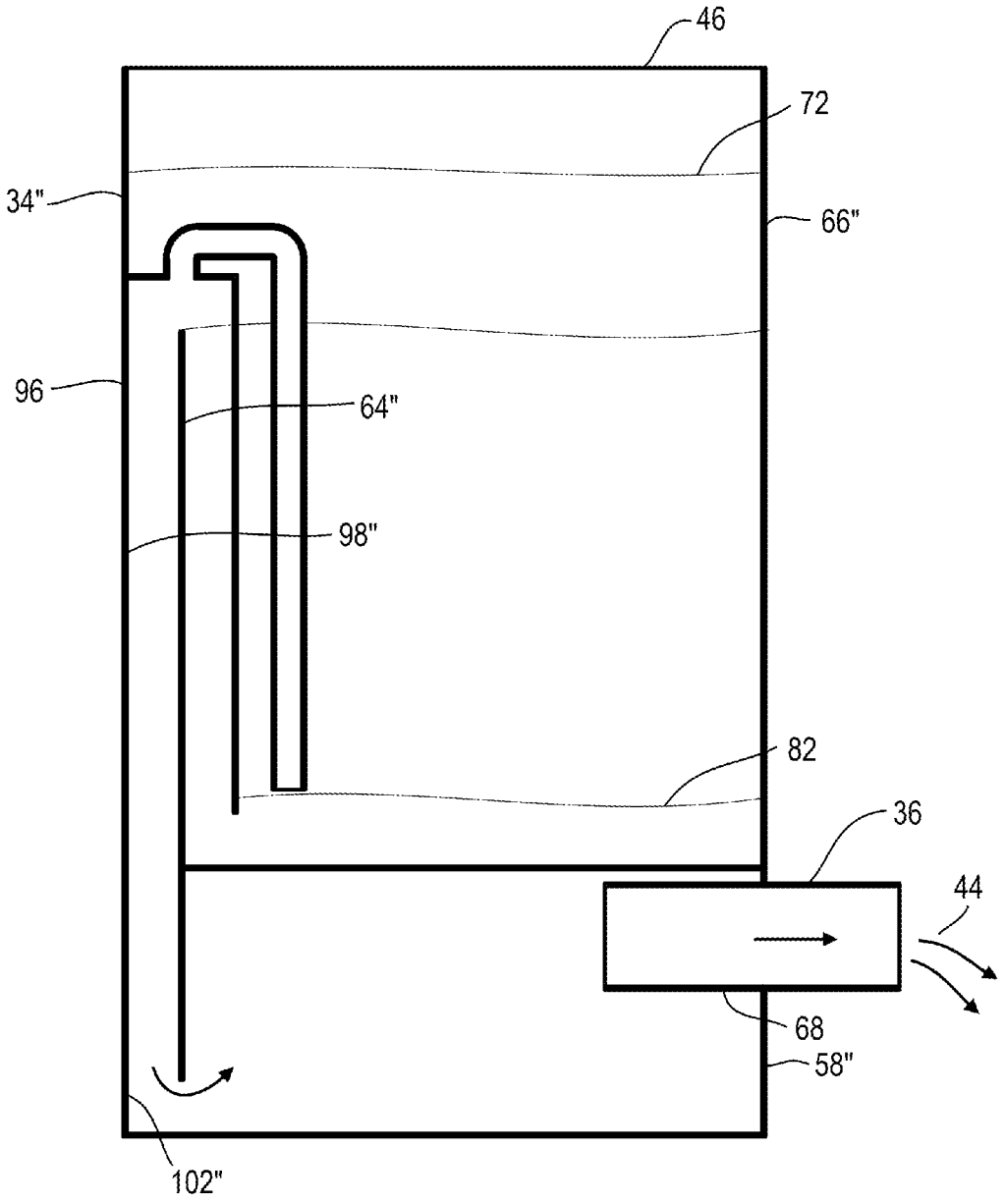
FIG. 3 is a highly schematic view of the example shown in FIG. 1 using a lift conduit on the inner surface of the outer tank.
Figure 8:
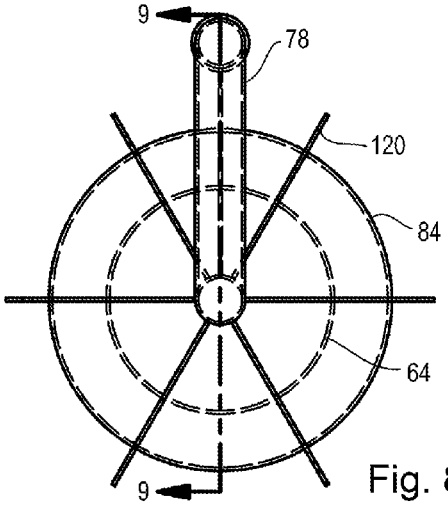
FIG. 8 is a top view of the apparatus shown in FIG. 7.
Figure 7:
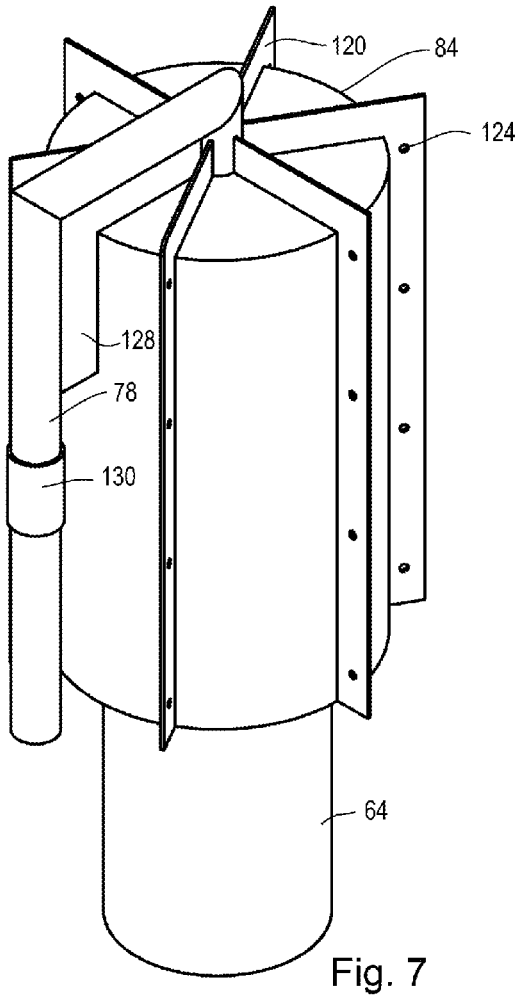
FIG. 7 is an isometric view of several of the inner components of FIG. 4.
Figure 9:
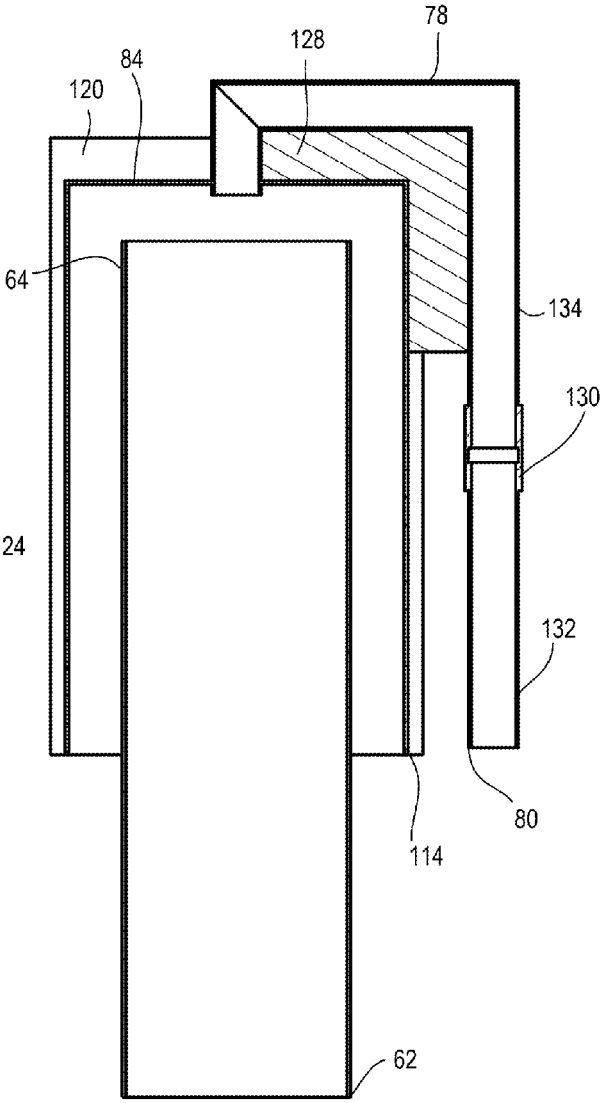
FIG. 9 is a cutaway view taken along line 9-9 of FIG. 8.
Figure 10:
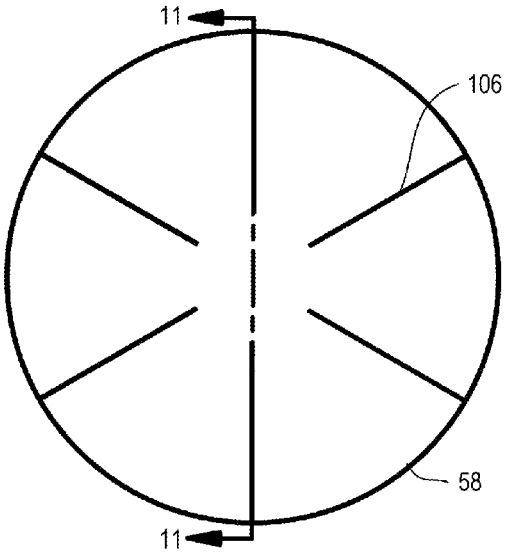
FIG. 10 is a top view of a bottom portion of the apparatus shown in FIG. 4.
Figure 11:
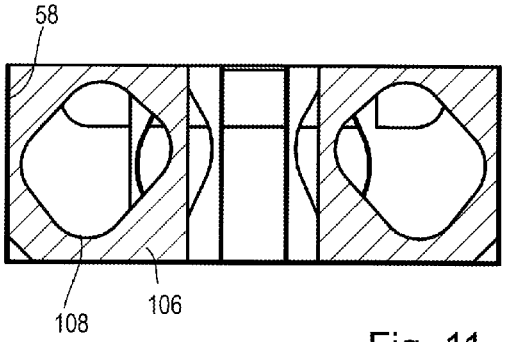
FIG. 11 is a cutaway view taken along line 11-11 of FIG. 10.
Figure 12:
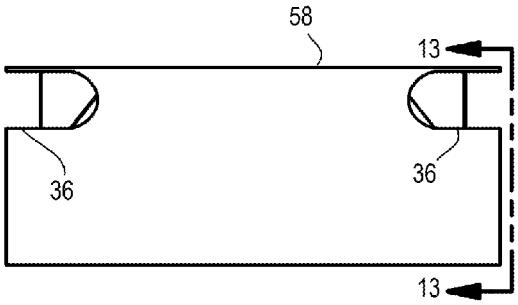
FIG. 12 is a side view of the apparatus shown in FIG. 10.
Figure 13:
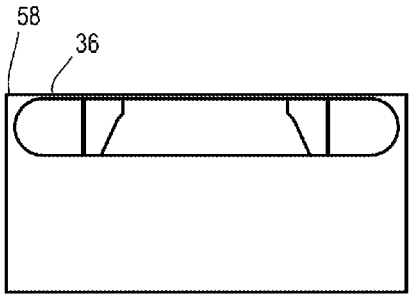
FIG. 13 is a front view of the apparatus shown in FIG. 10.
Figure 15:
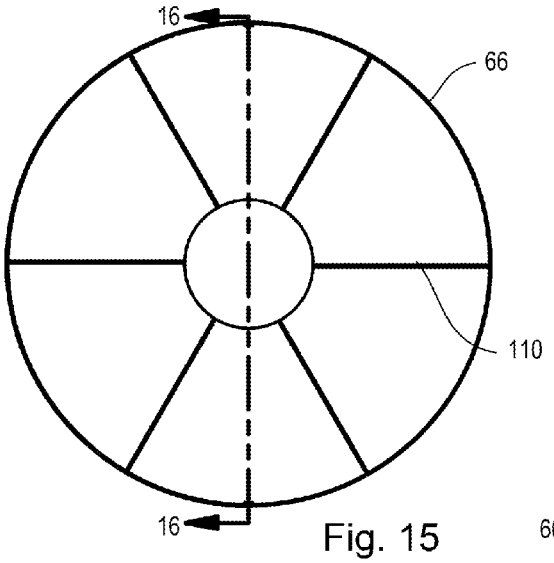
FIG. 15 is a top view of the apparatus shown in FIG. 14.
Figure 16:
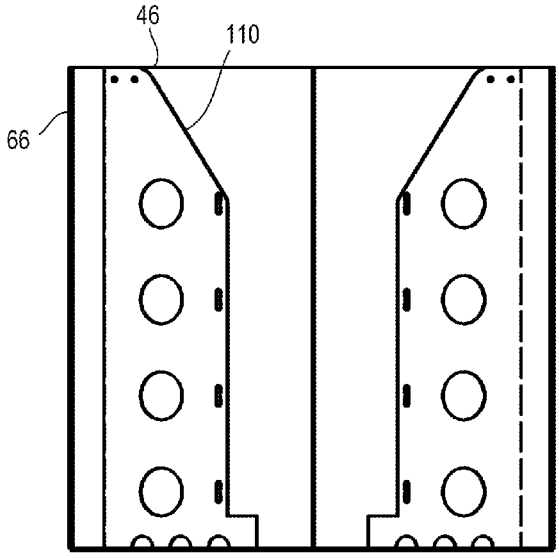
FIG. 16 is a cutaway view taken along line 16-16 of FIG. 15.
Figure 14:
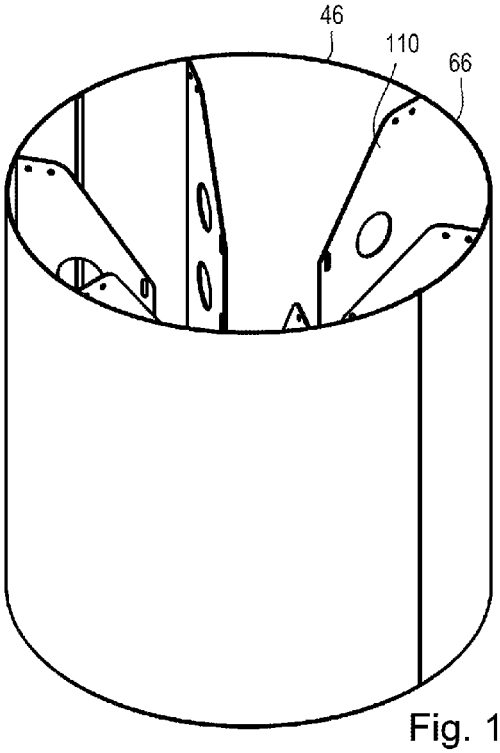
FIG. 14 is a top isometric view of a portion of the apparatus shown in FIG. 5.

Looking to FIG. 3 is shown a third example of the apparatus 20. In this example, components having a similar design or function to that shown in the previous examples utilize the same numeric identifier with a double apostrophe (") to denote the third example. In this example, the reservoir assembly 34" includes an upper reservoir 66"having an outer wall surface 96" and an inner surface 98". In this example it can be seen that the one surface of the drain conduit 64" is formed by the inner surface 98" of the upper reservoir 66" and an inner surface 102" of the lower reservoir 58".

Looking to FIG. 4 is shown the example of FIG. 1 in more detail and in an isometric view so as to show construction details not present in FIG. 1. In this example the upper reservoir 66 has been removed to show the inner components however, the upper reservoir 66 is shown in FIGS. 5, 6 and 14-16. The lower reservoir 58 is shown. In this example, the outlets 36 are very large side openings. In one example, it is disclosed to include a screen 104 to cover the openings 36 to reduce or remove the possibility of debris flowing through the apparatus onto a patron 26. FIG. 4 also shows internal gussets 106 providing rigidity and support structure for the apparatus 20. To ensure proper water flow from the drain conduit 64 to the outlets 36, surfaces defining openings 108 may be provided in the gussets 106. The surfaces defining openings 108 also reduce the overall weight of the apparatus 20. In one form, the radially outward edge 110 of the gussets 106 does not extend to the inner surface 102 of the lower reservoir 58 to further improve water flow around the gussets 106.

FIG. 4 also shows a plurality of gussets 110 fitted within the upper reservoir 66 to provide rigidity and support to the upper reservoir 66 and also to properly position and support the drain conduit 64. In one form, the gussets 110 have surfaces defining openings 112 through the gussets 110 two also allow water flow freely past the gussets 110. The openings 112 not only ensure an even distribution of water 30 within the upper reservoir 66 during filling operations, but also ensure an even flow of water during a flush or purge cycle. Similar surfaces defining openings 122 may be provided in the lower edges of the gussets 110 adjacent the lower surface 88 of the upper reservoir 66. These openings 122 allowing for water flow there through especially in a seasonal drain cycle.

To allow the drain conduit 64 to properly position the bottom edge 114 of the drain conduit 64 relative to the lower surface 88 of the upper reservoir 66, surfaces defining vertically elongated openings 116 may be provided in the gussets 110 and fasteners past and tightened through the openings 116 to the drain conduit 64.

Testing has also shown that compressive forces upon the drain conduit 64 may deform the drain conduit 64 especially the upper surface 118.

Thus, support gussets 120 may be attached to the drain conduit 64 on the sides and upper surface 118 thereof such as by welding or other methods. In one form, surfaces defining openings 124 allowing for fasteners 126 to pass there through may be provided which engage the vertically elongated openings 116 as previously described.

Looking to FIG. 6, a stabilizing fin 128 may be attached to the vent conduit 78 to ensure proper positioning thereof. FIG. 6 also shows an adjustment system 130 allowing an installer in the field to adjust a lower section 132 of the vent conduit 78 to be vertically adjusted relative to the bottom edge 114 of the drain conduit 64. In one form, the adjuster 130 is a threaded apparatus such that as the lower section 132 is rotated relative to the upper section 134, the vertical positioning of the lower edge 80 of the vent conduit 78 relative to the lower edge 114 of the drain conduit 64 may be adjusted for proper operation of the apparatus relative to a fill/purge cycle. In one form, it may be desired to have a ½ inch to three-quarter inch vertical offset 134 to eliminate a gurgling effect found in testing. Without proper adjustment of the vent conduit 78, as the siphon is broken during a purge cycle, the water flowing vertically downward in the flow zone 54 with simultaneous down flow of water through the drain conduit 64 as the water 30 is at the low level 82 results in an oscillating effect which may significantly hinder operation.

In one form, a screen 136 or other protective layer may be provided on the upper surface 46 of the upper reservoir 66 to keep animals, insects, and other debris out of the upper reservoir 66 where it may interfere with operation of the apparatus 20 or potentially may be ejected during a purge cycle and potentially injure a patron or otherwise form a detriment.

Although several of the examples are shown utilizing a substantially cylindrical upper reservoir 66, lower reservoir 58, lift conduit 84, vent conduit 78, and drain conduit 64 the particular shape of these components being cylindrical is not required. These components may be spherical, octagonal, other geometric shapes or may alternatively themed such as for example a clown wherein the outflow openings 36 are the mouth and ears of a clown, an octopus wherein the outflow openings 36 are tentacles, either rigid or malleable to allow for movement as water 30 passes there through.

In addition, it may be desired to have the top reservoir comprising a translucent or clear region to allow patrons to view the water level 50 as the upper reservoir 66 is filled. To further enable patrons to view the water level 50 floating components which do not affect operation of the apparatus such as large balls, or a ring may float on the water surface and these floating components will be easily seen through a translucent or clear region of the upper reservoir 66.

The components may be formed by different fabrication methods such as by sheet metal bending and forming, casting, molding, milling, extrusion, etc.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A water dump apparatus for a water park feature in a water park, the apparatus comprising:

an upper reservoir configured to retain a volume of water therein substantially above a patron region of the water park;

the upper reservoir having a lower interior surface, an upper edge, and a surrounding sidewall;

a fluid inlet conduit in fluid communication with the interior surface of the upper reservoir configured to be coupled to a water pump providing a flow of water into the upper reservoir at an inflow rate;

a substantially vertical lift conduit in fluid communication with the upper reservoir having a lower edge substantially above the lower surface of the upper reservoir and an upper edge substantially below the upper edge of the upper reservoir;

a substantially vertical drain conduit sealed to the lift conduit and having an upper edge below and in fluid communication with the upper edge of the lift conduit and a lower edge below the lower edge of the lift conduit;

an outflow in fluid communication with the lower edge of the drain conduit configured to periodically outflow water to the patron region at an outflow rate; and wherein the outflow rate is higher than the inflow rate.

2. The water dump apparatus as recited in claim 1 further comprising a lower reservoir in fluid communication between the drain conduit and the outflow.

3. The water dump apparatus as recited in claim 2 further comprising a plurality of outlets through sidewalls of the lower reservoir.

4. The water dump apparatus as recited in claim 3 wherein at least one outlet has a lower edge vertically above the lower edge of the drain conduit such that a volume of water is retained between the lower edge vertically and the lower edge of the drain conduit forming a headspace in the lower reservoir configured to produce a headspace in the upper reservoir above the upper edge of the drain conduit.

5. The water dump apparatus as recited in claim 1 further comprising a vent conduit having an upper end in fluid communication with an upper region of the lift conduit, and a lower end positioned above the lower edge of the lift conduit.

6. The water dump apparatus as recited in claim 1 further comprising a seasonal drain provided in the lower reservoir configured to continuously allow passage of water there through and drain the lower reservoir when the water pump is not actuated.

7. The water dump apparatus as recited in claim 1 wherein the outflow is above the patron region of the water park.

* * * * *